US010305210B2

(12) United States Patent
Tamura et al.

(10) Patent No.: US 10,305,210 B2
(45) Date of Patent: May 28, 2019

(54) TERMINAL PLATING MATERIAL, AND TERMINAL, TERMINAL-EQUIPPED ELECTRIC WIRE AND WIRE HARNESS USING THE SAME

(71) Applicant: YAZAKI CORPORATION, Tokyo (JP)

(72) Inventors: Nobuyuki Tamura, Shizuoka (JP); Hayato Ikeya, Shizuoka (JP); Shinobu Kayama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/877,449

(22) Filed: Jan. 23, 2018

(65) Prior Publication Data

US 2018/0212350 A1 Jul. 26, 2018

(30) Foreign Application Priority Data

Jan. 24, 2017 (JP) ..... 2017-010170

(51) Int. Cl.
*C22C 5/06* (2006.01)
*C25D 3/46* (2006.01)
(Continued)

(52) U.S. Cl.
CPC ..... *H01R 13/03* (2013.01); *C22C 5/06* (2013.01); *C25D 3/64* (2013.01); *C25D 7/00* (2013.01);
(Continued)

(58) Field of Classification Search
CPC ..... H01R 13/03; H01R 4/184; C22C 5/06; C25D 3/64; C25D 5/12; C25D 7/0607
See application file for complete search history.

(56) References Cited

U.S. PATENT DOCUMENTS 5,235,743 A * 8/1993 Endo ..... H01R 13/03 29/874
9,401,556 B2 7/2016 Tsugawa et al.
(Continued)

FOREIGN PATENT DOCUMENTS

CN 105525131 A 4/2016
JP 2009-079250 A 4/2009
(Continued)

OTHER PUBLICATIONS

Chinese office action dated Mar. 1, 2019 in a counterpart Chinese Patent application.

*Primary Examiner* — Edwin A. Leon
*Assistant Examiner* — Oscar C Jimenez
(74) *Attorney, Agent, or Firm* — Metrolexis Law Group, PLLC

(57) ABSTRACT

A terminal plating material includes a metal substrate, and a silver-tin alloy plating layer containing a silver-tin alloy, arranged on the metal substrate. The silver-tin alloy plating layer contains an intermetallic compound of silver and tin, the Vickers hardness of the surface of the silver-tin alloy plating layer in the terminal plating material is 250 Hv or more, and the surface roughness of the silver-tin alloy plating layer is 0.60 μmRa or less. Further, a terminal is formed from the terminal plating material. A terminal-equipped electric wire includes the terminal. A wire harness includes the terminal-equipped electric wire.

9 Claims, 5 Drawing Sheets

(51) Int. Cl.

| | |
|---|---|
| ***C25D 3/64*** | (2006.01) |
| ***C25D 7/00*** | (2006.01) |
| ***H01R 13/03*** | (2006.01) |
| ***C25D 7/06*** | (2006.01) |
| ***H01R 4/18*** | (2006.01) |
| *C25D 3/12* | (2006.01) |
| *C25D 5/12* | (2006.01) |

(52) U.S. Cl.
CPC ..... *C25D 7/0607* (2013.01); *H01R 4/184* (2013.01); *C25D 3/12* (2013.01); *C25D 3/46* (2013.01); *C25D 5/12* (2013.01)

(56) References Cited

U.S. PATENT DOCUMENTS

2004/0038072 A1* 2/2004 Miura ..... H01L 23/49582 428/668
2015/0047879 A1* 2/2015 Shibuya ..... C23C 14/14 174/126.2
2015/0255906 A1* 9/2015 Shibuya ..... B32B 15/01 439/887
2016/0172069 A1 6/2016 Sumiya et al.
2016/0186294 A1* 6/2016 Maki ..... C22C 9/00 174/68.2
2016/0265127 A1* 9/2016 Sadamori ..... C25D 3/46
2016/0348260 A1* 12/2016 Takahashi ..... H01R 13/03
2017/0253008 A1* 9/2017 Cahalen ..... C25D 5/12
2017/0271800 A1* 9/2017 Wagman ..... H01R 13/40
2017/0370015 A1* 12/2017 Sadamori ..... B32B 15/018

FOREIGN PATENT DOCUMENTS

JP 2012-226994 A 11/2012
JP 2015-183216 A 10/2015
JP 2016-015224 A 1/2016

* cited by examiner

TERMINAL PLATING MATERIAL, AND TERMINAL, TERMINAL-EQUIPPED ELECTRIC WIRE AND WIRE HARNESS USING THE SAME

CROSS REFERENCE TO RELATED APPLICATION

This application is based upon and claims the benefit of priority from the prior Japanese Patent Application No. 2017-010170, filed on Jan. 24, 2017, the entire contents of which are incorporated herein by reference.

BACKGROUND

1. Technical Field

The present invention relates to a terminal plating material, and a terminal, a terminal-equipped electric wire and a wire harness using the same. More specifically, the present invention relates to a terminal plating material, and a terminal, a terminal-equipped electric wire and a wire harness using the same, which also have high abrasion resistance while minimizing an increase in contact resistance.

2. Background Art

In recent years, demands for hybrid vehicles and electric vehicles have increased, and a high current flows through the terminals of the charging connector used in these vehicles.

However, tin plating generally used in gasoline vehicles is high in electric resistance, thus it tends to generate heat. Also, since heat resistance is not so high, there is a fear that the tin plating deteriorates due to this heat. For this reason, it has been suggested to use silver or silver alloy plating with low electric resistance instead of tin plating for terminals used in hybrid vehicles and electric vehicles.

For example, Japanese Unexamined Patent Application Publication No. 2009-79250 discloses a member in which a silver or silver alloy layer having an antimony concentration of 0.1% by mass or less is formed on at least a part of the surface of a copper or copper alloy member, and a silver alloy layer having a Vickers hardness of Hv 140 or more is formed as an outermost layer on the silver or silver alloy layer.

SUMMARY

However, since a charging connector used in hybrid vehicles and electric vehicles is repeatedly inserted and removed, it was necessary to increase the layer thickness even in the silver or silver alloy layer of Japanese Unexamined Patent Application Publication No. 2009-79250. On the other hand, when the layer thickness is increased, there are problems that the plating time increases and the amount of plating materials to be used also needs to be increased. Also, even in the case of a terminal with silver or silver alloy plating, contact resistance may not be so small in some cases, so that a terminal with a further reduced contact resistance has been required.

The present invention has been made in view of such problems of the prior art. An object of the present invention is to provide a terminal plating material, and a terminal, a terminal-equipped electric wire, and a wire harness using the same, which also have high abrasion resistance while minimizing an increase in contact resistance.

A terminal plating material according to a first aspect of the present invention is a terminal plating material including a metal substrate, and a silver-tin alloy plating layer containing a silver-tin alloy, arranged on the metal substrate, wherein the silver-tin alloy plating layer contains an intermetallic compound of silver and tin, a Vickers hardness of the surface of the silver-tin alloy plating layer in the terminal plating material is 250 Hv or more, and a surface roughness of the silver-tin alloy plating layer is 0.60 μmRa or less.

A terminal plating material according to a second aspect of the present invention relates to the terminal plating material of the first aspect, and the Vickers hardness of the silver-tin alloy plating layer in the terminal plating material after being heated at 50° C. to 200° C. for 20 minutes or more is 250 Hv or more.

A terminal according to a third aspect of the present invention is formed from the terminal plating material of the first or second aspect.

A terminal-equipped electric wire according to a fourth aspect of the present invention includes the terminal of the third aspect.

A wire harness according to a fifth aspect of the present invention includes the terminal-equipped electric wire of the fourth aspect.

According to the present invention, abrasion resistance of the terminal plating material, and the terminal, the terminal-equipped electric wire and the wire harness using the same also can be increased while minimizing an increase in contact resistance.

DETAILED DESCRIPTION

Figure 1:
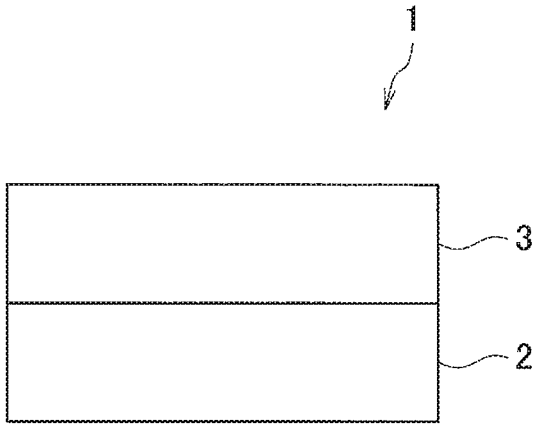
FIG. 1 is a schematic diagram showing an example of a terminal plating material according to this embodiment.

Hereinbelow, the terminal plating material, and the terminal, the terminal-equipped electric wire and the wire harness using the same according to this embodiment will be described in detail with reference to the drawings. The dimensional ratios in the drawings are exaggerated for convenience of explanation and may differ from the actual ratios.

[Terminal Plating Material 1]

A terminal plating material 1 of this embodiment includes a metal substrate 2, and a silver-tin alloy plating layer 3 containing a silver-tin alloy, arranged on the metal substrate 2. Therefore, the terminal plating material 1 of this embodiment has low electrical resistance as compared to the conventional tin plating and the like, and is less likely to generate heat even in places where a high current flows like hybrid vehicles and electric vehicles.

Also, the silver-tin alloy plating layer 3 contains an intermetallic compound of silver and tin. The Vickers hardness of the surface of the silver-tin alloy plating layer 3 in the terminal plating material 1 is 250 Hv or more. Therefore, the terminal plating material 1 of this embodiment has high abrasion resistance, and when used as a terminal, the plating layer is hardly worn even when the terminal is repeatedly inserted and removed. Furthermore, the surface roughness of the silver-tin alloy plating layer 3 is 0.60 μmRa or less. Therefore, contact resistance is small, heat generation when used as a terminal is suppressed, and power consumption can be reduced. Details of each configuration of this embodiment will be described hereinbelow.

(Metal Substrate 2)

The metal substrate 2 is a material to be plated with the silver-tin alloy plating layer 3. As the material for forming the metal substrate 2, at least one kind selected from the group consisting of metals with high conductivity, for example, copper, copper alloys, aluminum, aluminum alloys, iron and iron alloys can be used. The specific shape of the metal substrate 2 is not particularly limited, and it may be a shape according to the use.

(Silver-Tin Alloy Plating Layer 3)

The silver-tin alloy plating layer 3 is arranged on the metal substrate 2. The silver-tin alloy plating layer 3 has a role of protecting the metal substrate 2 from corrosion. From the viewpoint of corrosion prevention and moldability, the silver-tin alloy plating layer 3 preferably entirely covers the metal substrate 2.

The ratio of the content (% by mass) of silver to tin in the silver-tin alloy plating layer 3 is preferably silver:tin=65:35 to 80:20. In addition to silver and tin, the silver-tin alloy plating layer 3 preferably contains at least one element selected from the group consisting of In, Zn, Ti and Sb. This is because an intermetallic compound with silver is produced by containing such an element in the silver-tin alloy plating layer 3, and an improvement in the Vickers hardness of the surface of the silver-tin alloy plating layer 3 is expected.

The silver-tin alloy plating layer 3 contains an intermetallic compound of silver and tin. In this embodiment, the silver-tin alloy plating layer 3 contains the intermetallic compound, so that the hardness of the silver-tin alloy plating layer 3 can be improved. Such an intermetallic compound is precipitated by controlling the concentration of silver and tin in the plating solution. Examples of the intermetallic compound include $Ag_3Sn$ and the like. Examples of the intermetallic compound in the case where the silver-tin alloy plating layer 3 contains at least one element selected from the group consisting of In, Zn, Ti and Sb, in addition to silver and tin, include $Ag_3In$, AgZn, AgTi, $Ag_7Sb$, and the like.

The Vickers hardness of the surface of the silver-tin alloy plating layer 3 in the terminal plating material 1 is 250 Hv or more. In this embodiment, by setting the Vickers hardness of the surface of the silver-tin alloy plating layer 3 within such a range, abrasion resistance can be improved. The Vickers hardness of the surface of the silver-tin alloy plating layer 3 is preferably 280 Hv or more. The Vickers hardness can be measured according to Japanese Industrial Standard JIS Z2244:2009 (Vickers hardness Test-Test Method). In addition, the Vickers hardness can be measured at a test temperature of 25° C. and a test force of 3 gf.

The Vickers hardness of the surface of the silver-tin alloy plating layer 3 in the terminal plating material 1 after being heated at 50° C. to 200° C. for 20 minutes or more is preferably 250 Hv or more. When silver or a silver alloy is placed under a high temperature environment, silver crystal grains become large and the hardness of the silver or the silver alloy may decrease. However, in this embodiment, the silver-tin alloy plating layer 3 contains an intermetallic compound of silver and tin. Therefore, by setting the Vickers hardness of the surface of the silver-tin alloy plating layer 3 in the terminal plating material 1 after being heated at 50° C. to 200° C. for 20 minutes or more to the above-mentioned range, it is possible to make it difficult to reduce abrasion resistance even when the terminal plating material 1 is used under a high temperature environment. The Vickers hardness of the surface of the silver-tin alloy plating layer 3 in the terminal plating material 1 after being heated at 50° C. to 200° C. for 20 minutes or more is more preferably 280 Hv or more. The Vickers hardness can be measured according to JIS Z2244:2009. In addition, the Vickers hardness can be measured at a test temperature of 25° C. and a test force of 3 gf.

The surface roughness of the silver-tin alloy plating layer 3 is 0.60 μmRa or less. By setting the surface roughness of the silver-tin alloy plating layer 3 in such a range, contact resistance can be reduced. The surface roughness of the silver-tin alloy plating layer 3 is preferably 0 μmRa or more and 0.25 μmRa or less. The surface roughness is the arithmetical mean roughness and can be measured according to JIS B0601:2013 (Geometrical Product Specifications (GPS)-Surface texture: Profile method-Terms, definitions and surface texture parameters).

The thickness of the silver-tin alloy plating layer 3 is preferably 0.1 μm or more, and more preferably 1 μm or more, from the viewpoint of corrosion resistance. Also, the thickness of the silver-tin alloy plating layer 3 is preferably 30 μm or less, and more preferably 20 μm or less, from the viewpoint of productivity and cost reduction.

The silver-tin alloy plating layer 3 can be formed, for example, by preparing a silver-tin alloy plating bath by mixing a tin salt in a silver plating bath, and plating the metal substrate 2 by immersing it in the silver-tin alloy plating bath. Plating is preferably performed by constant current electrolysis because it is easy to control the film thickness.

The silver-tin plating bath used for the silver-tin alloy plating layer 3 can contain, for example, a silver salt, a tin salt, a conductive salt, a brightener, and the like. Examples of the material used for the silver salt include silver cyanide, silver iodide, silver oxide, silver sulfate, silver nitrate, silver chloride, and the like. Also, examples of the conductive salt include potassium cyanide, sodium cyanide, potassium pyrophosphate, potassium iodide, sodium thiosulfate, and the like. Examples of the brightener include metal brighteners such as antimony, selenium and tellurium, and organic brighteners such as benzenesulfonic acid and mercaptan.

Examples of the material used for the tin salt of the silver-tin alloy plating layer 3 include organic stannous sulfonates such as stannous methanesulfonate, stannous salts such as stannous pyrophosphate, stannous chloride, stannous sulfate, stannous acetate, stannous sulfamate, stannous gluconate, stannous tartrate, stannous oxide, stannous fluoroborate, stannous succinate, stannous lactate, stannous citrate, stannous phosphate, stannous iodide, stannous formate and stannous fluorosilicate, and stannic salts such as sodium stannate and potassium stannate.

The current density in the case of electroplating the silver-tin alloy plating layer 3 is preferably 0.3 $A/dm^2$ or more, and more preferably 0.9 $A/dm^2$ or more. When the current density is increased, silver-tin alloy plating can be performed in a faster time, and productivity is improved. However, when the current density is increased, the surface becomes rough and the surface roughness Ra increases. Therefore, the upper limit of the current density is set so as to satisfy the condition of the surface roughness in consideration of various factors such as productivity, composition of the plating bath, ion concentration, and shape of the object to be plated. The plating bath temperature in the case of electroplating the silver-tin alloy plating layer 3 is preferably 0° C. to 50° C., and more preferably 20° C. to 40° C. By setting the plating bath temperature in such a range, the silver-tin alloy plating layer 3 can be effectively formed by a complex effect.

(Nickel Plating Layer 4)

Figure 2:
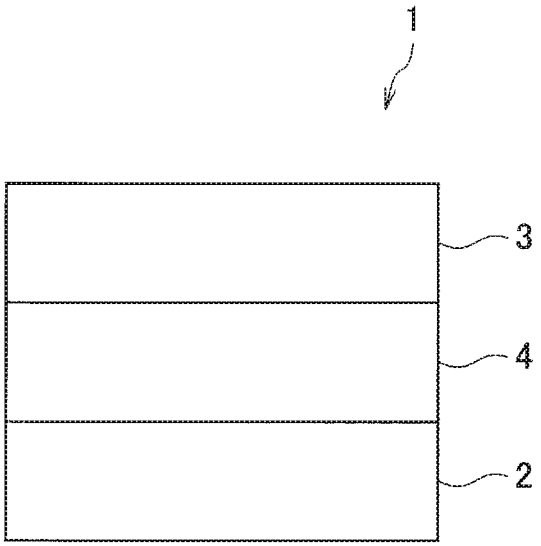
FIG. 2 is a schematic diagram showing an example of a terminal plating material according to this embodiment.

As shown in FIG. 2, the terminal plating material 1 of this embodiment may include a nickel plating layer 4. The nickel plating layer 4 functions as a base layer of the silver-tin alloy plating layer 3, suppresses diffusion of elements constituting the substrate to the silver-tin alloy plating layer 3, and can improve contact reliability and heat resistance. In the embodiment shown in FIG. 2, the nickel plating layer 4 is arranged between the metal substrate 2 and the silver-tin alloy plating layer 3. The thickness of the nickel plating layer 4 is preferably 0.1 μm to 3.0 μm, and more preferably 0.1 μm to 1.0 μm. Instead of the nickel plating layer 4 or in addition to the nickel plating layer 4, other layer may be added according to the use.

The method of forming the nickel plating layer 4 is not particularly limited, but the metal substrate 2 can be placed in a nickel plating bath and plated by a known plating method.

The nickel plating bath can contain, for example, a nickel salt, a pH buffering agent, a brightener, and the like. Examples of the material used for the nickel salt include nickel sulfate, nickel chloride, nickel sulfamate, and the like. Examples of the pH buffering agent include boric acid, citric acid, nickel acetate, and the like. Examples of the brightener include sulfanates, saccharin, sulfonamide, sulfinic acid, naphthalene, sodium naphthalenesulfonate, nickel acetate, and the like.

The current density in the case of electroplating the nickel plating layer 4 is preferably 2.0 A/dm$^2$ to 15.0 A/dm$^2$, and more preferably 2.0 A/dm$^2$ to 10.0 A/dm$^2$. The plating bath temperature in the case of electroplating the nickel plating layer 4 is preferably 45° C. to 65° C. It is preferable since nickel plating can be performed with a high current density by setting the plating bath temperature in such a range.

(Silver Strike Plating Layer 5)

Figure 3:
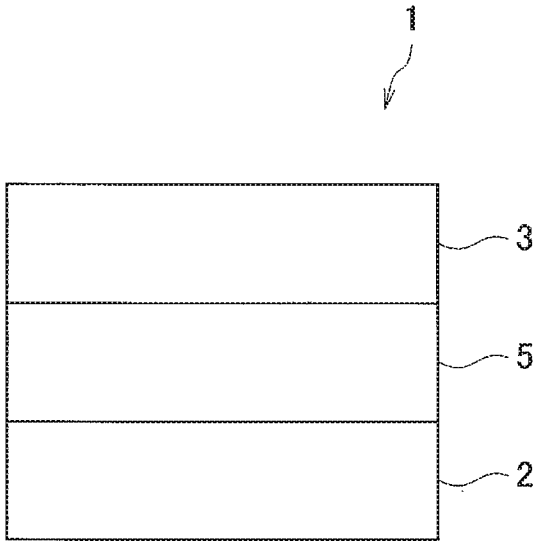
FIG. 3 is a schematic diagram showing an example of a terminal plating material according to this embodiment.
Figure 4:
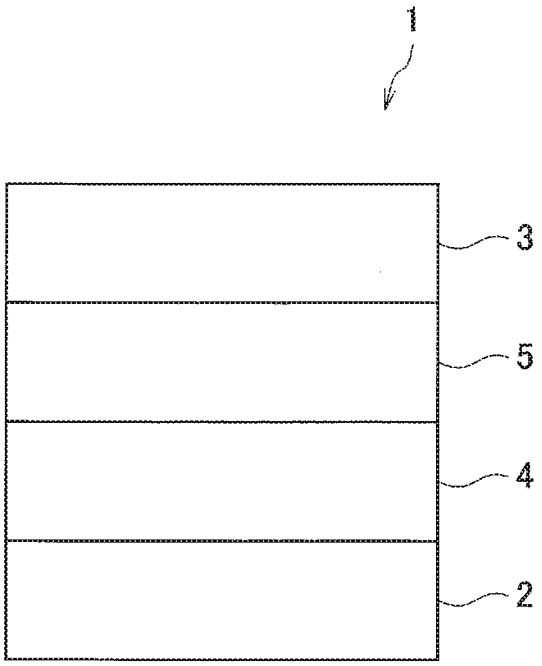
FIG. 4 is a schematic diagram showing an example of a terminal plating material according to this embodiment.

As shown in FIGS. 3 and 4, the terminal plating material 1 of this embodiment may include a silver strike plating layer 5. The silver strike plating layer 5 functions as a base layer of the silver-tin alloy plating layer 3 and can improve the adhesion of the silver-tin alloy plating layer 3 to the metal substrate 2 or the nickel plating layer 4. In the embodiment shown in FIG. 3, the silver strike plating layer 5 is arranged between the metal substrate 2 and the silver-tin alloy plating layer 3. In the embodiment shown in FIG. 4, the silver strike plating layer 5 is arranged between the nickel plating layer 4 and the silver-tin alloy plating layer 3. The thickness of the silver strike plating layer 5 is preferably 0.1 μm to 1.5 μm, and more preferably 0.1 μm to 1.0 μm. In place of the silver strike plating layer 5 or in addition to the silver strike plating layer 5, other layer may be added according to the use.

The method of forming the silver strike plating layer 5 is not particularly limited, but the metal substrate 2 or the metal substrate 2 on which the nickel plating 4 has been applied can be placed in a silver strike plating bath and plated by a known plating method.

The silver strike plating bath can contain, for example, a silver salt, a conductive salt, a brightener, and the like. Examples of the material used for the silver salt include silver cyanide, silver iodide, silver oxide, silver sulfate, silver nitrate, silver chloride, and the like. Also, examples of the conductive salt include potassium cyanide, sodium cyanide, potassium pyrophosphate, potassium iodide, sodium thiosulfate, and the like. Examples of the brightener include metal brighteners such as antimony, selenium and tellurium, benzenesulfonic acid, mercaptan, and the like.

The current density in the case of electroplating the silver strike plating layer 5 is preferably 1.6 A/dm$^2$ or more, and more preferably 2.0 A/dm$^2$ or more. The upper limit of the current density is set in consideration of various factors such as productivity, composition of the plating bath, ion concentration, and shape of the object to be plated. The plating bath temperature in the case of electroplating the silver strike plating layer 5 is preferably 20° C. to 30° C. It is preferable since the possibility of burning can be reduced by setting the plating bath temperature in such a range.

The contact resistance of the terminal plating material 1 of this embodiment is preferably 0 mΩ or more and 5.0 mΩ or less. By setting the contact resistance of the terminal plating material 1 in such a range, it is possible to reduce heat generation and power consumption when used as a terminal. The contact resistance of the terminal plating material 1 is more preferably 0 mΩ or more and 2.5 mΩ or less, and further preferably 0 mΩ or more and 1.0 mΩ or less. Contact resistance can be measured using, for example, an electrical contact simulator CRS-1103-AL manufactured by Yamasaki Seiki Kenkyusho, Inc.

The terminal plating material 1 of this embodiment includes the metal substrate 2, and the silver-tin alloy plating layer 3 containing a silver-tin alloy, arranged on the metal substrate 2. Moreover, the silver-tin alloy plating layer 3 contains an intermetallic compound of silver and tin, the Vickers hardness of the surface of the silver-tin alloy plating layer 3 in the terminal plating material 1 is 250 Hv or more, and the surface roughness of the silver-tin alloy plating layer 3 is 0.60 μmRa or less. Therefore, when the terminal plating material 1 of this embodiment is used as a terminal, the abrasion resistance is also high while minimizing the increase in contact resistance.

[Terminal 10]

A terminal 10 of this embodiment is formed from a terminal plating material 1. Therefore, the terminal 10 of this embodiment has also high abrasion resistance while minimizing the increase in contact resistance as compared to the terminal plated with conventional silver or silver alloy. From the viewpoint of corrosion prevention and moldability, the silver-tin alloy plating layer 3 of the terminal 10 preferably entirely covers the metal substrate 2 of the terminal 10.

[Terminal-Equipped Electric Wire 20]

Figure 5:
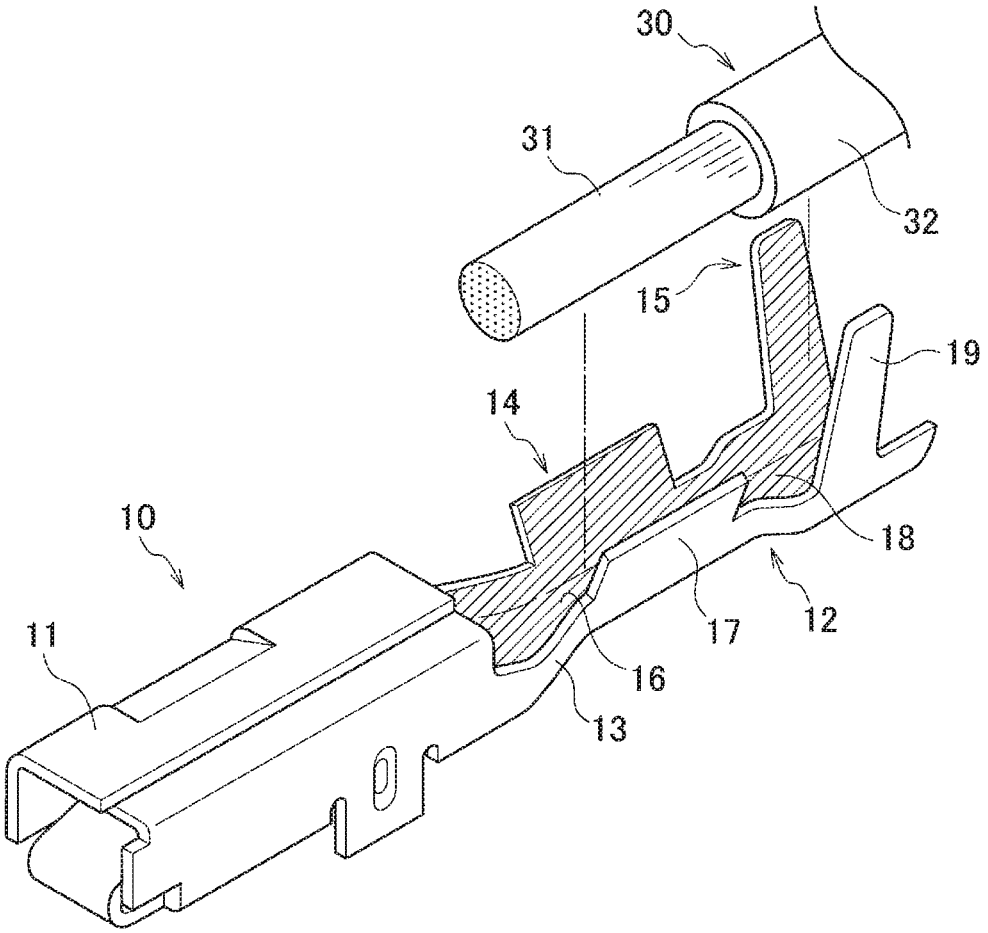
FIG. 5 is a perspective view showing an example of a terminal-equipped electric wire according to this embodiment before crimping the electric wire with the terminal.
Figure 6:
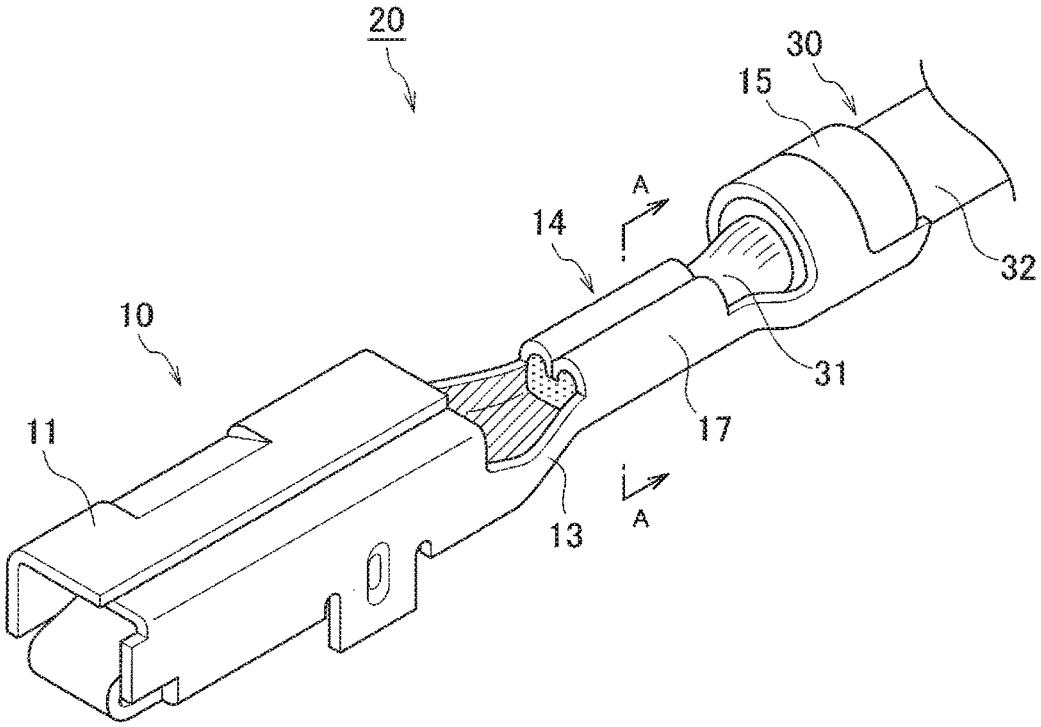
FIG. 6 is a perspective view showing an example of a terminal-equipped electric wire according to this embodiment after crimping the electric wire with the terminal.
Figure 7:
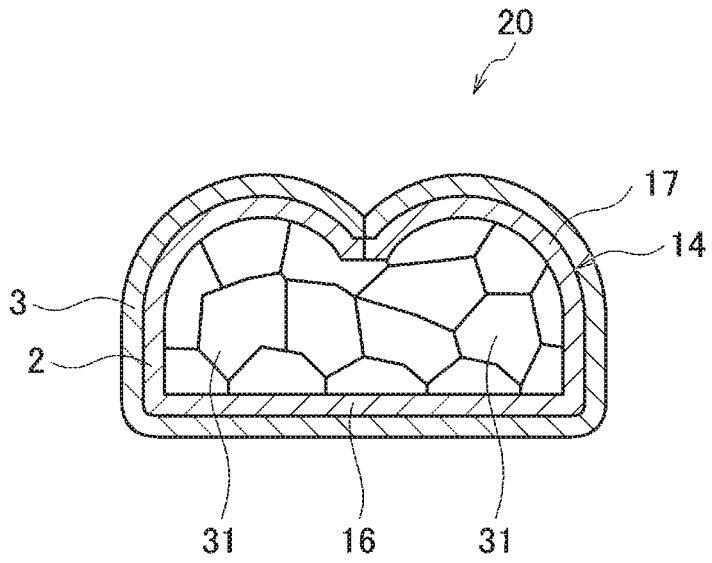
FIG. 7 is a cross-sectional view taken along line A-A in FIG. 6.

As shown in FIG. 5 to FIG. 7, a terminal-equipped electric wire 20 of this embodiment has a terminal 10. Specifically, the terminal-equipped electric wire 20 of this embodiment includes an electric wire 30 having a conductor 31 and an electric wire covering material 32 covering the conductor 31, and the terminal 10 connected to the conductor 31 of the electric wire 30 and formed from the terminal plating material. FIG. 5 shows a state before crimping the electric wire with the terminal, and FIG. 6 shows a state after crimping the electric wire with the terminal. FIG. 7 shows a cross-sectional view taken along line A-A in FIG. 6.

The terminal 10 shown in FIG. 5 is a female crimp terminal. The terminal 10 has an electrical connection part 11 connected to a mating terminal (not shown). The electrical connection part 11 has a box-like shape and incorporates a spring piece that engages with the mating terminal. Further, on the side opposite to the electrical connection part 11 in the terminal 10, an electric wire connection part 12 to be connected by caulking to the terminal portion of the electric wire 30 is provided. The electrical connection part 11 and the electric wire connection part 12 are connected via a connecting part 13. Although the electrical connection part 11, the electric wire connection part 12 and the connecting part 13 are made of the same material and integrated together to constitute the terminal 10, and names are given to each portion for convenience.

The electric wire connection part 12 includes a conductor crimping part 14 for caulking the conductor 31 of the electric wire 30 and a covering material caulking part 15 for caulking the electric wire covering material 32 of the electric wire 30.

The conductor crimping part 14 is in direct contact with the conductor 31 exposed by removing the electric wire covering material 32 at the terminal portion of the electric wire 30, and has a bottom plate part 16 and a pair of conductor caulking pieces 17. The pair of conductor caulking pieces 17 is extended upward from both side edges of the bottom plate part 16. The pair of conductor caulking pieces 17 is bent inward so as to wrap around the conductor 31 of the electric wire 30, whereby the conductor 31 can be caulked so as to closely contact the upper face of the bottom plate part 16. The conductor crimping part 14 is formed in a substantially U shape in cross section by the bottom plate part 16 and the pair of conductor caulking pieces 17.

The covering material caulking part 15 is in direct contact with the electric wire covering material 32 at the terminal portion of the electric wire 30, and has a bottom plate part 18 and a pair of covering material caulking pieces 19. The pair of covering material caulking pieces 19 is extended upward from both side edges of the bottom plate part 18. The pair of covering material caulking pieces 19 is bent inward so as to wrap around the portion with the electric wire covering material 32, whereby the electric wire covering material 32 can be caulked in a state of closely contacting the upper face of the bottom plate part 18. The covering material caulking part 15 is formed in a substantially U shape in cross section by the bottom plate part 18 and the pair of covering material caulking pieces 19. The portion from the bottom plate part 16 of the conductor crimping part 14 to the bottom plate part 18 of the covering material caulking part 15 is continuously formed as a common bottom plate part.

The electric wire 30 has the conductor 31 and the electric wire covering material 32 covering the conductor 31. As the material of the conductor 31, a metal having high conductivity can be used. As the material of the conductor 31, for example, copper, a copper alloy, aluminum, an aluminum alloy or the like can be used. In recent years, weight reduction of electric wire is required. Therefore, it is preferable that the conductor 31 is made of lightweight aluminum or an aluminum alloy.

As the material of the electric wire covering material 32 covering the conductor 31, a resin capable of ensuring electrical insulation can be used. As the material of the electric wire covering material 32, for example, an olefin type resin can be used. Specifically, as the material of the electric wire covering material 32, at least one kind selected from the group consisting of polyethylene (PE), polypropylene (PP), ethylene copolymer and propylene copolymer can be used as a main component. In addition, as the material of the electric wire covering material 32, polyvinyl chloride (PVC) can also be used as a main component. Among them, it is preferable that the material of the electric wire covering material 32 contains polypropylene or polyvinyl chloride as a main component since flexibility and durability are high. The main component herein refers to a component of 50% by mass or more of the entire electric wire covering material.

The terminal 10 can be manufactured, for example, as follows. First, as shown in FIG. 5, the terminal portion of the electric wire 30 is inserted into the electric wire connection part 12 of the terminal 10. Consequently, the conductor 31 of the electric wire 30 is placed on the upper face of the bottom plate part 16 of the conductor crimping part 14, and the portion with the electric wire covering material 32 of the electric wire 30 is placed on the upper face of the bottom plate part 18 of the covering material caulking part 15. Next, the conductor crimping part 14 and the covering material caulking part 15 are deformed by pressing the electric wire connection part 12 and the terminal portion of the electric wire 30. Specifically, the pair of conductor caulking pieces 17 of the conductor crimping part 14 is bent inward so as to wrap around the conductor 31, whereby the conductor 31 is caulked so as to closely contact the upper face of the bottom plate part 16. Further, the pair of covering material caulking pieces 19 of the covering material caulking part 15 is bent inward so as to wrap around the portion with the electric wire covering material 32, whereby the electric wire covering material 32 can be caulked so as to closely contact the upper face of the bottom plate part 18. By doing so, as shown in FIGS. 6 and 7, the terminal 10 and the electric wire 30 can be crimped and connected.

The terminal-equipped electric wire 20 of this embodiment has the terminal 10. Therefore, the terminal-equipped electric wire 20 of this embodiment has high abrasion resistance at the terminal 10 portion, as compared to the conventional terminal plated with silver or silver alloy, and an increase in contact resistance can be minimized. Therefore, the terminal-equipped electric wire 20 of this embodiment can be suitably also used in places like hybrid vehicles and electric vehicles.

[Wire Harness]

A wire harness 40 of this embodiment includes the terminal-equipped electric wire 20. Specifically, as shown in FIG. 8, the wire harness of this embodiment includes a connector 50 and the terminal-equipped electric wire 20.

Figure 8:
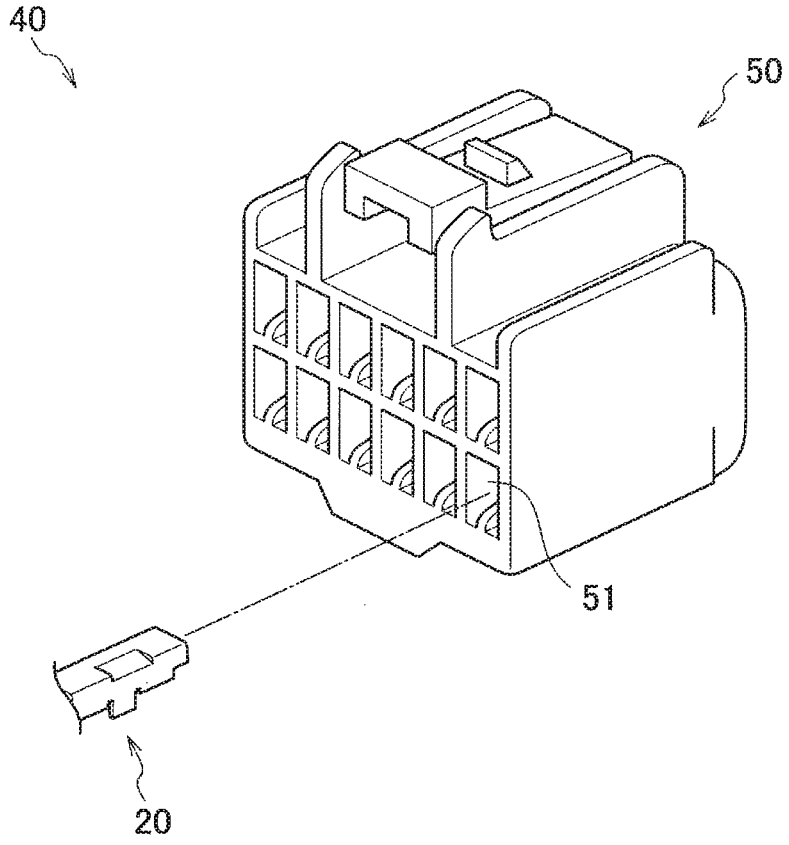
FIG. 8 is a perspective view showing an example of a wire harness according to this embodiment.

In FIG. 8, on the rear side of the connector 50, a plurality of mating terminal mounting parts (not shown) to which mating terminals (not shown) are mounted is provided. In FIG. 8, on the front side of the connector 50, a plurality of cavities 51 to which the terminals 10 of the terminal-equipped electric wires 20 are mounted is provided. In each cavity 51, a substantially rectangular opening is provided so that the terminal 10 of the terminal-equipped electric wire 20 is mounted. Further, the opening of each cavity 51 is formed to be slightly larger than the cross section of the terminal 10 of the terminal-equipped electric wire 20. When the terminal 10 of the terminal-equipped electric wire 20 is mounted to the cavity 51 of the connector 50, the electric wire 30 is pulled out from the rear side of the connector 50.

The wire harness 40 of this embodiment includes the terminal-equipped electric wire 20. Therefore, the wire harness 40 of this embodiment has high abrasion resistance at the terminal 10 portion, as compared to the conventional terminal plated with silver or silver alloy, and an increase in contact resistance can be minimized. Therefore, the wire harness 40 of this embodiment can be suitably also used in places like hybrid vehicles and electric vehicles.

EXAMPLES

Hereinbelow, the present invention will be described in more detail with reference to examples and comparative examples, but the present invention is not limited to these examples.

First, pretreatment of a metal substrate as a material to be plated was performed. Specifically, the metal substrate was washed by alkali degreasing, and immersed in 10% sulfuric acid for 2 minutes for pickling, followed by water washing. For the metal substrate, a C1020-H copper plate specified in JIS H3100:2012 (Copper and copper alloy sheets, plates and strips) was used.

Next, a nickel plating layer was formed on the surface of the metal substrate. Specifically, the pretreated metal substrate was immersed in a plating bath for a nickel plating layer, and was subjected to constant current electrolysis under the conditions of a current density of 5 A/dm$^2$, an electrolysis time of 30 seconds, and a plating bath temperature of 55° C., using a DC stabilized power supply. After completion of the electrolysis, the metal substrate was taken out from the plating bath and washed with water. As a result, a metal substrate having a nickel plating layer formed on the entire surface of the metal substrate was obtained. The composition of the plating bath for a nickel plating layer is 240 g/L of nickel sulfate, 45 g/L of nickel chloride, and 30 g/L of boric acid. The thickness of the nickel plating layer was 1.0 μm. In addition, PA18-5B manufactured by TEXIO TECHNOLOGY CORPORATION was used as the DC stabilized power supply.

Next, a silver strike plating layer was formed on the nickel plating layer. Specifically, the metal substrate on which the nickel plating layer was formed was immersed in a plating bath for a silver strike plating layer, and was subjected to constant current electrolysis under the conditions of a current density of 2.5 A/dm$^2$, an electrolysis time of 1 min, and a plating bath temperature of 25° C., using a DC stabilized power supply. After completion of the electrolysis, the metal substrate was taken out from the plating bath and washed with water. As a result, a metal substrate having a silver strike plating layer formed on the entire surface of the metal substrate on which the nickel plating layer was formed was obtained. The composition of the plating bath for a silver strike plating layer is 4.2 g/L of silver cyanide and 80 g/L of potassium cyanide. The thickness of the silver strike plating layer was 0.3 μm. In addition, PA18-5B manufactured by TEXIO TECHNOLOGY CORPORATION was used as the DC stabilized power supply.

Next, a silver-tin alloy plating layer was formed on the silver strike plating layer. Specifically, the metal substrate on which the silver strike plating layer was formed was immersed in a plating bath for a silver-tin alloy plating layer prepared as shown in Tables 1 and 2, and was subjected to constant current electrolysis under the conditions shown in Tables 1 and 2, at a plating bath temperature of 25° C., using a DC stabilized power supply. The electrolysis time was adjusted so that the thickness of the silver-tin alloy plating layer to be formed was 5 μm. In addition, PA18-5B manufactured by TEXIO TECHNOLOGY CORPORATION was used as the DC stabilized power supply.

[Evaluation]

Evaluation was performed on the test samples of examples and comparative examples by the following method. The results are also shown in Table 1 and Table 2.

(Composition of Silver-Tin Alloy Plating Layer)

The composition of the silver-tin alloy plating layer was confirmed by analyzing the obtained test sample with a scanning electron microscope (SEM)-energy dispersive X-ray spectroscopy (EDX).

(Intermetallic Compound of Silver-Tin Alloy Plating Layer)

The intermetallic compound of the silver-tin alloy plating layer was confirmed by X-ray crystal structure analysis of the obtained test sample using an X-ray diffractometer (XRD).

(Vickers Hardness)

The Vickers hardness was evaluated by measuring the surface of the obtained test sample according to JIS Z2244:2009, using a micro hardness tester DUH-211 manufactured by Shimadzu Corporation. The test temperature was set at 25° C., and the test force was set at 3 gf. The Vickers hardness was evaluated by measuring before and after heating the test sample. The test sample after heating was heated at 160° C. for 150 hours and then cooled to 25° C., and the Vickers hardness was measured.

(Abrasion Resistance)

The abrasion resistance was evaluated by performing a sliding test. The sliding test was evaluated using a sliding test apparatus CRS-B1050 manufactured by Yamasaki Seiki Kenkyusho, Inc. The conditions of the sliding test are as follows.

Number of sliding 200 times

Sliding width 5 mm

Sliding speed 3 mm/s

Contact load 2N (constant)

Indent shape R=1 mm

The case where the abrasion depth after the sliding test was 5 μm or less was evaluated as "X", and the case where the abrasion depth exceeding 5 μm was evaluated as "Y".

(Surface Roughness)

For the surface roughness, the arithmetical mean roughness of the surface of the obtained test sample was measured according to JIS B0601:2013, using a contact type surface roughness measuring instrument Alpha-Step D500 manufactured by KLA-Tencor Corporation.

(Contact Resistance)

For the contact resistance, the surface of the obtained test sample was measured using an electrical contact simulator CRS-1103-AL manufactured by Yamasaki Seiki Kenkyusho, Inc. The measurement conditions of contact resistance are as follows.

Contact load 200 gf (constant)

Electrode φ 0.5 mm U-shaped gold wire (Contact Reliability)

The contact reliability was evaluated as "X" when the contact resistance measured as described above was 5.0 mΩ or less, and "Y" when the contact resistance exceeded 5.0 mΩ.

TABLE 1

| | | Example 1 | Example 2 | Example 3 | Example 4 |
|---|---|---|---|---|---|
| Plating bath | | Silver ion concentration: 26.0 g/L Tin ion concentration: 10.0 g/L | Silver ion concentration: 26.5 g/L Tin ion concentration: 8.0 g/L | Silver ion concentration: 31.0 g/L Tin ion concentration: 7.0 g L | Silver ion concentration: 40.0 g/L Tin ion concentration: 7.0 g/L |
| Electrolysis conditions | Current density ($A/dm^2$) | 0.92 | 1.45 | 2.52 | 2.82 |
| | Plating bath: temperature (° C.) | 25 | 40 | 35 | 20 |
| Composition (% by mass) | | Ag 68% by mass - Sn 32% by mass | Ag 73% by mass - Sn 27% by mass | Ag 76% by mass - Sn 24% by mass | Ag 77% by mass - Sn 23% by mass |
| Intermetallic compound | | $Ag_3Sn$ | $Ag_3Sn$ | $Ag_3Sn$ | $Ag_3Sn$ |
| Vickers hardness (Hv) | Before heating | 264 | 310 | 287 | 280 |
| | After heating | 262 | 307 | 281 | 275 |
| Abrasion resistance | | X | X | X | X |
| Surface roughness (μmRa) | | 0.243 | 0.244 | 0.248 | 0.249 |
| Contact resistance (mΩ) | | 1.3 | 1.1 | 0.9 | 1.0 |
| Contact reliability | | X | X | X | X |

TABLE 2

| | | Comparative Example 1 | Comparative Example 2 | Comparative Example 3 | Comparative Example 4 |
|---|---|---|---|---|---|
| Plating bath | | Silver ion concentration; 26.5 g/L Tin ion concentration; 8.0 g/L | Silver ion concentration: 26.0 g/L Tin ion concentration: 11.0 g/L | Silver ion concentration: 26.5 g/L Tin ion concentration: 8.0 g/L | Silver ion concentration: 30 g/L Antimony ion concentration: 0.05 g/L |
| Electrolysis conditions | Current density ($A/dm^2$) | 3.42 | 2.52 | 1.43 | 2.50 |
| | Plating bath temperature (° C.) | 25 | 55 | 55 | 25 |
| Composition (% by mass) | | Ag 73% by mass - Sn 27% by mass | Ag 65% by mass - Sn 35% by mass | Ag 100% by mass | Ag 99% by mass - Sb 1% by mass |
| Intermetallic compound | | $Ag_3Sn$ | $Ag_3Sn$ | Not detected | Not detected |
| Vickers hardness (Hv) | Before heating | 330 | 187 | 142 | 200 |
| | After heating | 324 | 162 | 90 | 145 |
| Abrasion resistance | | X | Y | Y | Y |
| Surface roughness (μmRa) | | 0.622 | 0.221 | 0.215 | 0.146 |
| Contact resistance (mΩ) | | 5.23 | 1.7 | 0.2 | 0.52 |
| Contact reliability | | Y | X | X | X |

From the results in Table 1, the test samples of Examples 1 to 4 contain the intermetallic compound of silver and tin, and the Vickers hardness and surface roughness are within the predetermined ranges. Therefore, abrasion resistance and contact reliability were good. On the other hand, from the results in Table 2, the laminates of Comparative Examples 1 to 4 did not have the intermetallic compound of silver and tin, or the Vickers hardness or surface roughness was not within the predetermined range. Therefore, it could not be said that abrasion resistance and contact reliability were sufficient.

While the present invention has been described above by reference to the examples and the comparative examples, the present invention is not intended to be limited to the descriptions thereof, and various modifications will be apparent to those skilled in the art within the scope of the present invention.

The invention claimed is:

1. A terminal plating material comprising:

a metal substrate, and a silver-tin alloy plating layer containing a silver-tin alloy, arranged on the metal substrate, wherein the silver-tin alloy plating layer contains an intermetallic compound of silver and tin, a Vickers hardness of a surface of the silver-tin alloy plating layer in the terminal plating material is 250 Hv or more, and a surface roughness of the silver-tin alloy plating layer is 0.60 μmRa or less, a ratio, in % by mass, of silver to tin in the silver-tin alloy plating layer is from 65:35 to 80:20, and a thickness of the silver-tin alloy plating layer is 1 μm or more.

2. The terminal plating material according to claim 1, wherein the Vickers hardness of the surface of the silver-tin alloy plating layer in the terminal plating material after being heated at 50° C. to 200° C. for 20 minutes or more is 250 Hv or more.

3. A terminal formed from the terminal plating material according to claim 1.

4. A terminal-equipped electric wire comprising the terminal according to claim 3.

5. A wire harness comprising the terminal-equipped electric wire according to claim 4.

6. The terminal plating material according to claim 1, wherein the thickness of the silver-tin alloy plating layer is 30 μm or less.

7. The terminal plating material according to claim 1, further comprising a nickel plating layer arranged between the metal substrate and the silver-tin alloy plating layer.

8. The terminal plating material according to claim 1, further comprising a silver strike plating layer arranged between the metal substrate and the silver-tin alloy plating layer.

9. The terminal plating material according to claim 1, further comprising:

a nickel plating layer arranged on the metal substrate; and a silver strike plating layer arranged between the nickel plating layer and the silver-tin alloy plating layer.

* * * * *